US006791263B2

(12) United States Patent
Su et al.

(10) Patent No.: US 6,791,263 B2
(45) Date of Patent: Sep. 14, 2004

(54) ELECTRODE STRUCTURE OF A PLASMA DISPLAY PANEL

(75) Inventors: Yao-Ching Su, Tainan Hsien (TW); Yih-Jer Lin, Kao-Hsiung Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 305 days.

(21) Appl. No.: 09/851,576

(22) Filed: May 10, 2001

(65) Prior Publication Data

US 2002/0084750 A1 Jul. 4, 2002

(30) Foreign Application Priority Data

Dec. 29, 2000 (TW) ..... 89128207 A

(51) Int. Cl.[7] ..... H01J 17/49

(52) U.S. Cl. ..... 313/582; 313/583; 313/584; 313/585

(58) Field of Search ..... 313/582–585, 313/631

(56) References Cited

U.S. PATENT DOCUMENTS 6,031,329 A * 2/2000 Nagano ..... 313/582
6,465,956 B1 * 10/2002 Koshio et al. ..... 313/586

FOREIGN PATENT DOCUMENTS

| | | | | |
|---|---|---|---|---|
| CN | 1269570 A | * | 10/2000 | ..... G09F/09/313 |
| JP | 11297214 A | * | 10/1999 | ..... H01J/11/02 |
| JP | 2000123750 A | * | 4/2000 | ..... H01J/11/02 |

* cited by examiner

*Primary Examiner*—Sandra O'Shea
*Assistant Examiner*—Peter Macchiarolo
(74) *Attorney, Agent, or Firm*—Winston Hsu

(57) ABSTRACT

An electrode structure of a plasma display panel (PDP) is disclosed. The electrode structure is formed on a front substrate of the PDP. The electrode structure includes a first sustaining electrode, a second sustaining electrode, and an auxiliary electrode. The first and second sustaining electrodes are formed on the substrate with a first gap existing therebetween. The auxiliary electrode is formed in the first gap. A second gap is formed between the auxiliary electrode and the second sustaining electrode. The second gap is smaller than the first gap.

21 Claims, 11 Drawing Sheets

ELECTRODE STRUCTURE OF A PLASMA DISPLAY PANEL

BACKGROUND OF THE INVENTION

1. Field of the Invention

The present invention relates to an electrode structure of a plasma display panel (PDP), and more particularly, to an electrode structure of a PDP with a small discharge gap.

2. Description of the Prior Art

A plasma display panel (POP) is one kind of flat display using gas discharges to create brilliant images. Advantages of the PDP include thin and lightweight design, large display size, and wide viewing angle. The luminescent principle of the PDP involves the production of ultraviolet (UV) rays by plasma first, followed by irradiation of the UV rays to produce visible light. The production efficiency of plasma greatly influences the luminescent efficiency of the PDP. The luminescent efficiency of the PDP can be improved by many methods. For examples increasing UV production can improve the luminescent efficiency of the PDP, but increasing the luminescent efficiency of the fluorescence material is difficult. Nowadays, change of the filling gas and the electrode structure of the PDP will increase, the UV production.

Please refer to FIG. 1. FIG. 1 is a cross-sectional view of a PDP 10 in the prior art. The PDP 10 includes a front substrate 12 and a back substrate 14 positioned in parallel, a discharge gas (not shown) filled between the front substrate 12 and the back substrate 14, and two sustaining electrodes 16 formed on the surface of the front substrate 12. A discharge gap 17 is defined between the two sustaining electrodes 16. Two auxiliary electrodes 18 are formed above and parallel to the two sustaining electrodes 16 on the front substrate 12. A plurality of address electrodes 20 are formed on the surface of the back substrate 14 and perpendicular to the sustaining electrodes 16.

The PDP 10 further includes a dielectric layer 22, a protective layer 24, a plurality of ribs (not shown), and a fluorescent layer 26. The dielectric layer 22 covers the front substrate 12, and the protective layer 24 formed above the dielectric layer 22. The ribs are formed parallel to each other on the back substrate 14 for isolating two neighboring address electrodes 20. The fluorescent layer 26 are coated above the address electrode 20 and the sidewalls of each rib for producing red, green or blue light.

Generally speaking, the sustaining electrode 16 is transparent and composed of indium tin oxide (ITO). The transparent electrode is able to penetrate visible light but has a large resistance. The auxiliary electrode 18 is opaque and composed of Cr/Cu/Cr metal layers. The opaque electrode has a poor transparency and good conductivity. Thus, the auxiliary electrode 18 is positioned above the sustaining electrode 16 for increasing the conductivity of the sustaining electrode 16.

Referring to FIG. 2, it is a Paschen curve for showing the relationship between the firing voltage ($V_f$) of the PDP and the multiplication of the filling gas pressure (P value) with the discharge gap width (D value). When the PD value is equal to a constant C, the firing voltage $V_f$ will reduce to a minimum value. In the present PDP process, the pressure P of the filling gas is increased in order to heighten the brightness under a constant firing voltage as shown in FIG. 3. The filling gas is usually a mixture of Xe and Ne gases. However, as shown in FIG. 2, an increasing P value leads to an increasing $V_f$ value. In order to maintain the $V_f$ value, the D value (discharge gap) must be decreased. The width of the discharge gap 17, the distance between two sustaining electrodes 16, is determined by the photoresist patterned by a mask. However, the accuracy of the patterned photoresist is limited by the resolution of the optical exposure tool and the characteristics of the photoresist materials. Therefore, the pattern with a smaller distance between two sustaining electrode is not easily and exactly transfer to the dry film photoresist for forming a smaller discharge gap 17. Thereby, the large discharge gap will limit the quality of the PDP 10. In addition, a smaller discharge gap can be formed by the high resolution liquid photoresist, but the material cost will be increased. Moreover, the high standard clean room is needed when using the liquid photoresist, and the fabricating cost of the PDP is also increased.

BRIEF SUMMARY OF THE INVENTION

An objective of the present invention is to provide an electrode structure of a plasma display panel with a reduced discharge gap.

The present invention provides an electrode structure of a plasma display panel (PDP). The electrode structure is formed on a front substrate of the PDP. The electrode structure includes a first and a second sustaining electrode, and a first gap is defined between the first and the second sustaining electrode. The electrode structure further includes an auxiliary electrode electrically connected to the first sustaining electrode. The first sustaining electrode has a first side approaching to the second sustaining electrode and a second side far away from the second sustaining electrode.

In addition, the first auxiliary electrode has a first part and a second part, the first part is formed in the first gap, and the second part is formed above the first sustaining electrode and adjacent to the first side of the first sustaining electrode. A second gap exists between the first part of the first auxiliary electrode and the second sustaining electrode, and the width of the second gap is smaller than that of the first gap. The first auxiliary electrode further includes a third part adjacent to the second side of the first sustaining electrode. The third part of the first auxiliary electrode is formed on the surface of the front substrate or on the first sustaining electrode.

The PDP also includes a back substrate parallel to the front substrate, and a plurality of ribs formed on the back substrate and parallel to each other. The ribs are perpendicular to the axial direction of the first auxiliary electrode. The first auxiliary electrode further includes a fourth part parallel to the ribs. The second sustaining electrode includes a third side distal from the first sustaining electrode. The electrode structure also includes a second auxiliary electrode adjacent to the third side of the second sustaining electrode.

A first lithographic process patterns the first and the second sustaining electrodes, and a second lithographic process patterns the first auxiliary electrode. In the present invention, the misalignment of the auxiliary electrode and the sustaining electrode is obtained from twice lithographic processes for forming a smaller discharge gap. As a result, the discharge gap will not be limited by the resolution of the optical exposure tools and photoresist materials in the present invention. Therefore, the discharge gap is reduced and the image quality of the PDP can be improved.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
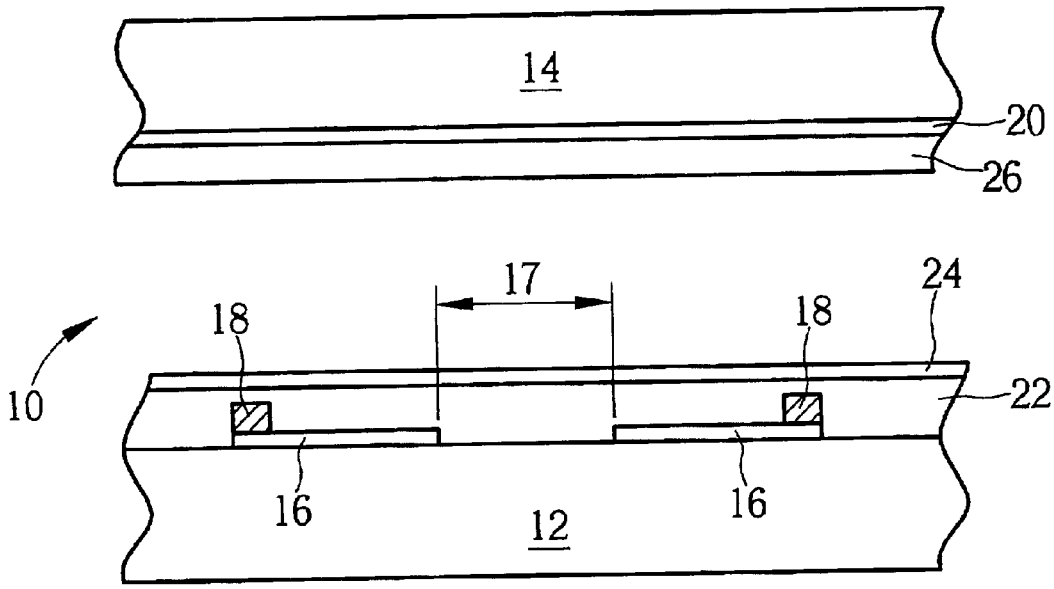
Fig. 1 Prior art
FIG. 1 is a cross-sectional view of a PDP in the prior art.
Figure 2:
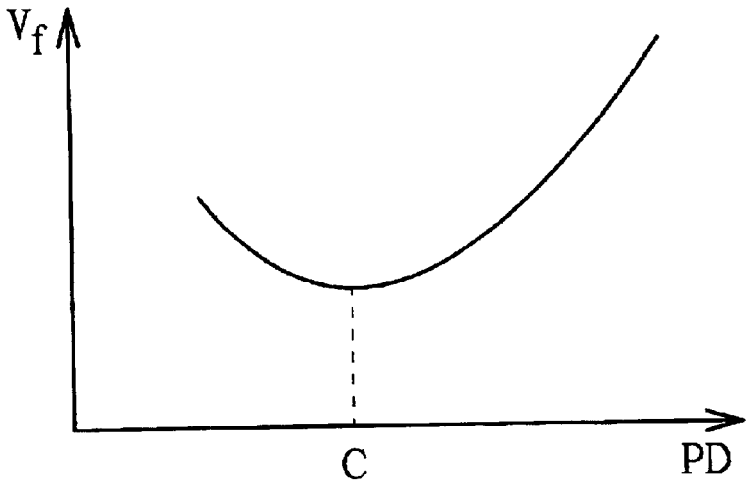
FIG. 2 is a Paschen curve for showing the relation between the firing voltage ($V_f$) and the product of the filling-gas pressure (P) and the discharge gap (D).
Figure 3:
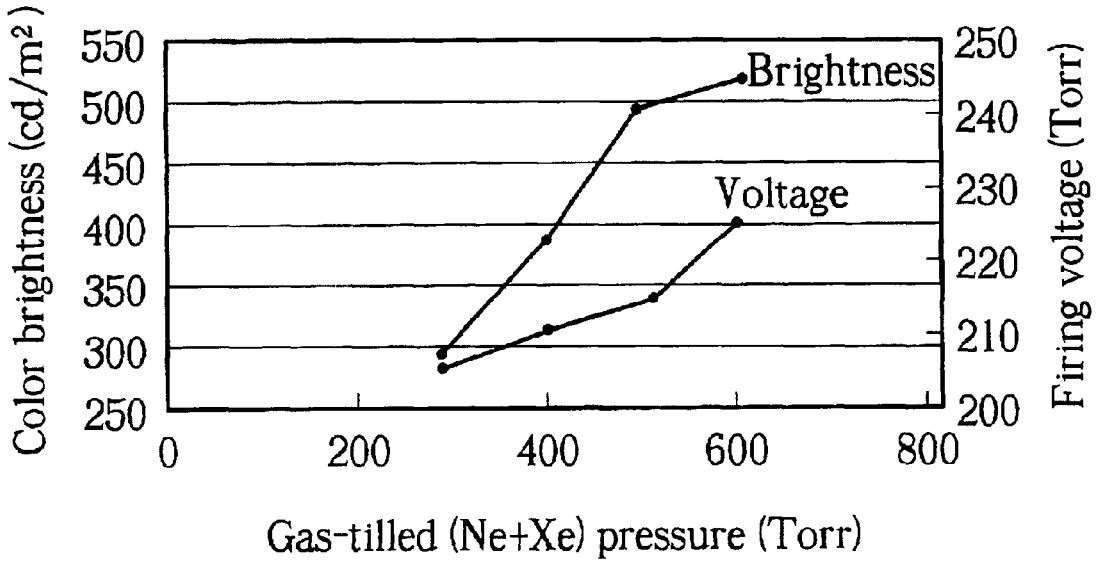
FIG. 3 is the relationship graph between the brightness, firing voltage ($V_f$), and filling-gas pressure of the PDP.
Figure 4A:
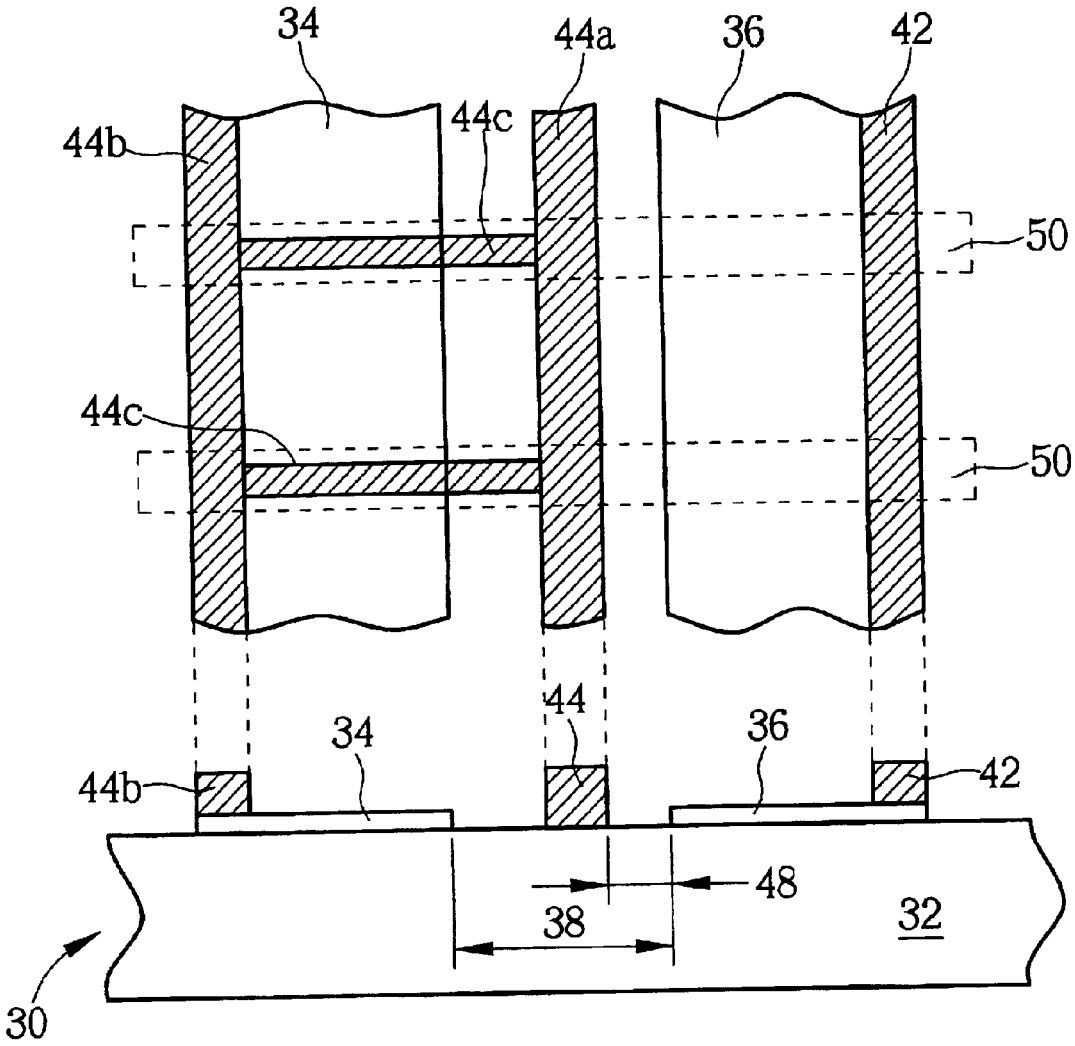
FIG. 4A to FIG. 4G are cross-sectional views of the electrode structures in the first embodiment according to the present invention.

Please refer to FIG. 4A to FIG. 4G, which are the cross-sectional views of the electrode structures of a PDP 30 in the present invention. As shown in FIG. 4A, the electrode structure is formed on a front substrate 32 of the PDP 30. The electrode structure includes a first sustaining electrode 34, a second sustaining electrode 36, a first auxiliary electrode 44, and a second auxiliary electrode 42. The first sustaining electrode 34 and second sustaining electrode 36 are formed on the surface of the front substrate 32 and a first gap 38 is defined between these electrodes. In addition, the first auxiliary electrode 44 has a first part 44*a* formed on the surface of the front substrate 32 in the first gap 38, a second part 44*b* formed above the first sustaining electrode 34, and a third part 44*c* for connecting the first part 44*a* and the second part 44*b*. The second auxiliary electrode 42 is formed above the second sustaining electrode 36. A second-gap 48 is defined between the first part 44*a* of the first auxiliary electrode 44 and the second sustaining electrode 36 and the second gap 48 is a discharge gap. As shown in the top view, the first sustaining electrode 34 and the second sustaining electrode 36 are parallel to the first auxiliary electrode 44 and the second auxiliary electrode 42.

Besides, the PDP 30 also includes a back substrate (not shown) parallel to the front substrate 32. A plurality of ribs 50 are formed on the back substrate, parallel to and spaced apart from each other with equal distance. A third part 44*c* of the first auxiliary electrode 44 is perpendicular to the first sustaining electrode 34 and the second sustaining electrode 36, and parallel to the ribs 50. Further, the third part 44*c* of the first auxiliary electrode 44 is in opposition to the ribs 50 on the back substrate to avoid the reduction of the transparency of the PDP 30.

The first sustaining electrode 34 and second sustaining electrode 36 are transparent electrodes and formed of indium tin oxide (ITO). The resistance of ITO is very large and easily affects the discharge efficiency. Therefore, an auxiliary electrode composed of Cr/Cu/Cr alloy is used to reduce the resistance. Moreover, a smaller discharge gap 48 is formed between the sustaining electrode 36 and the first part 44*a* of the auxiliary electrode 44 in the first gap 38 so that the problem in the prior art can be solved by reducing the firing voltage to increase the quality of the PDP 30.

Figure 4B:
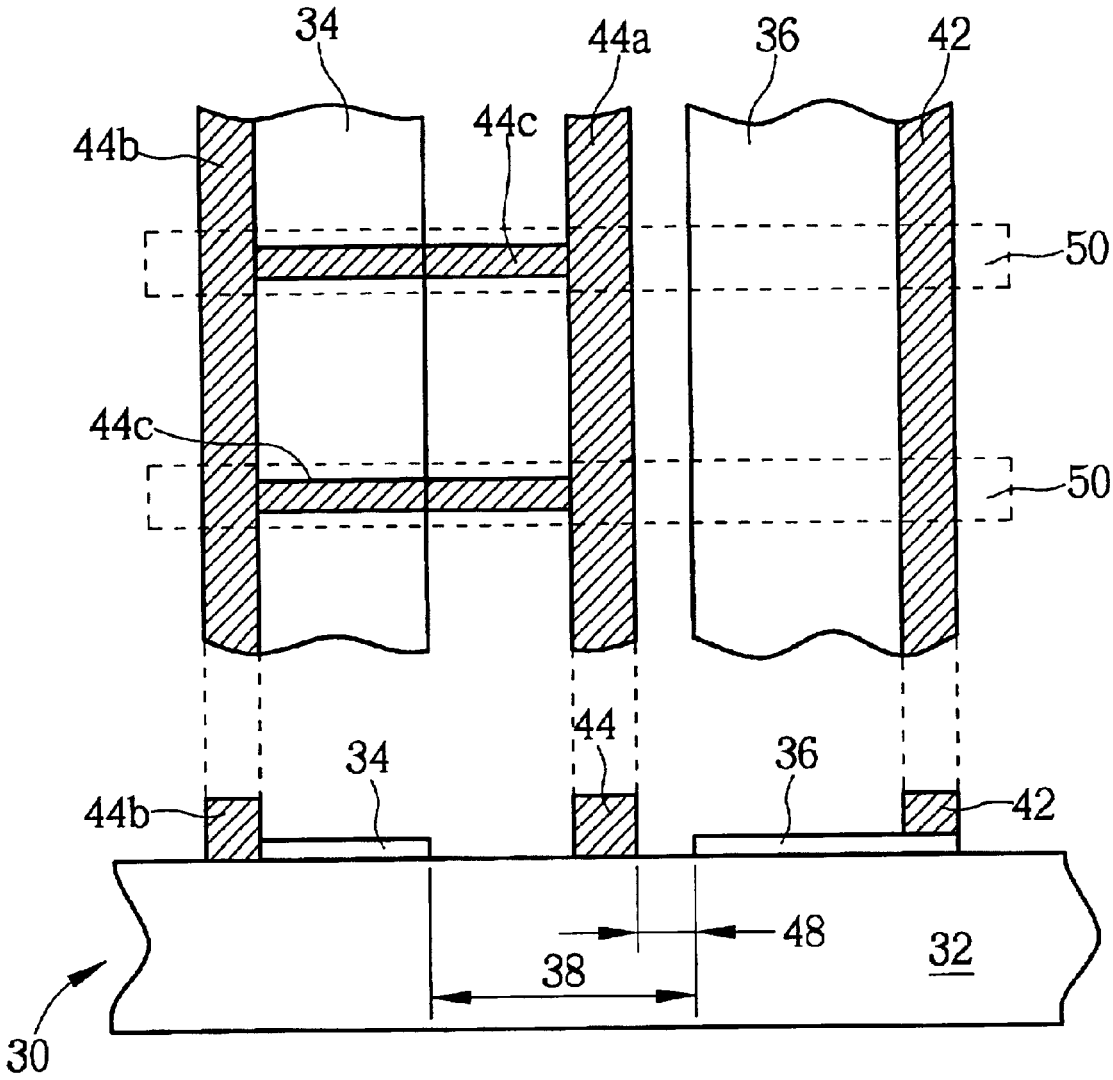

As shown in FIG. 4B, the difference between FIG. 4B and FIG. 4A is the position of the second part 44*b* of the first auxiliary electrode 44. In FIG. 4B, the second part 44*b* is located on the surface of front substrate 32 rather than on the sustaining electrode 34 in FIG. 4A. As well, the second part 44*b* of the first auxiliary electrode 44 can be located on both surfaces of the first sustaining electrode 34 and the front substrate 32.

Figure 4C:
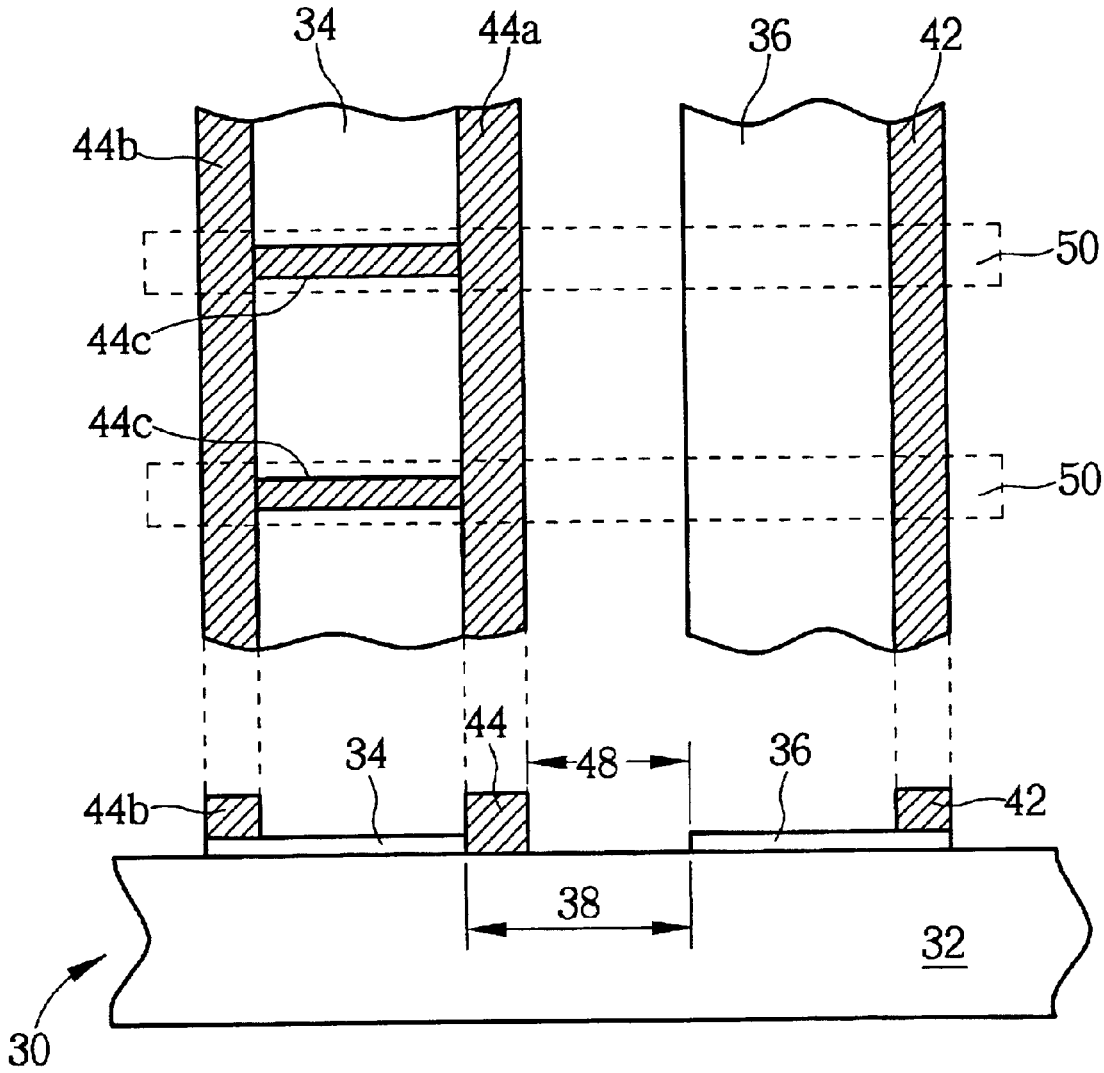

As shown in FIG. 4C, the first part 44*a* of the first auxiliary electrode 44 can be formed in the first gap 38 and adjacent to the first sustaining electrode 34. As a result, the distance between the first auxiliary electrode 44 and the second sustaining electrode 36 is shortened to a second gap 48. The second gap 48 is smaller than the first gap 38 for achieving the objective of reducing the firing voltage in the present invention.

Figure 4D:
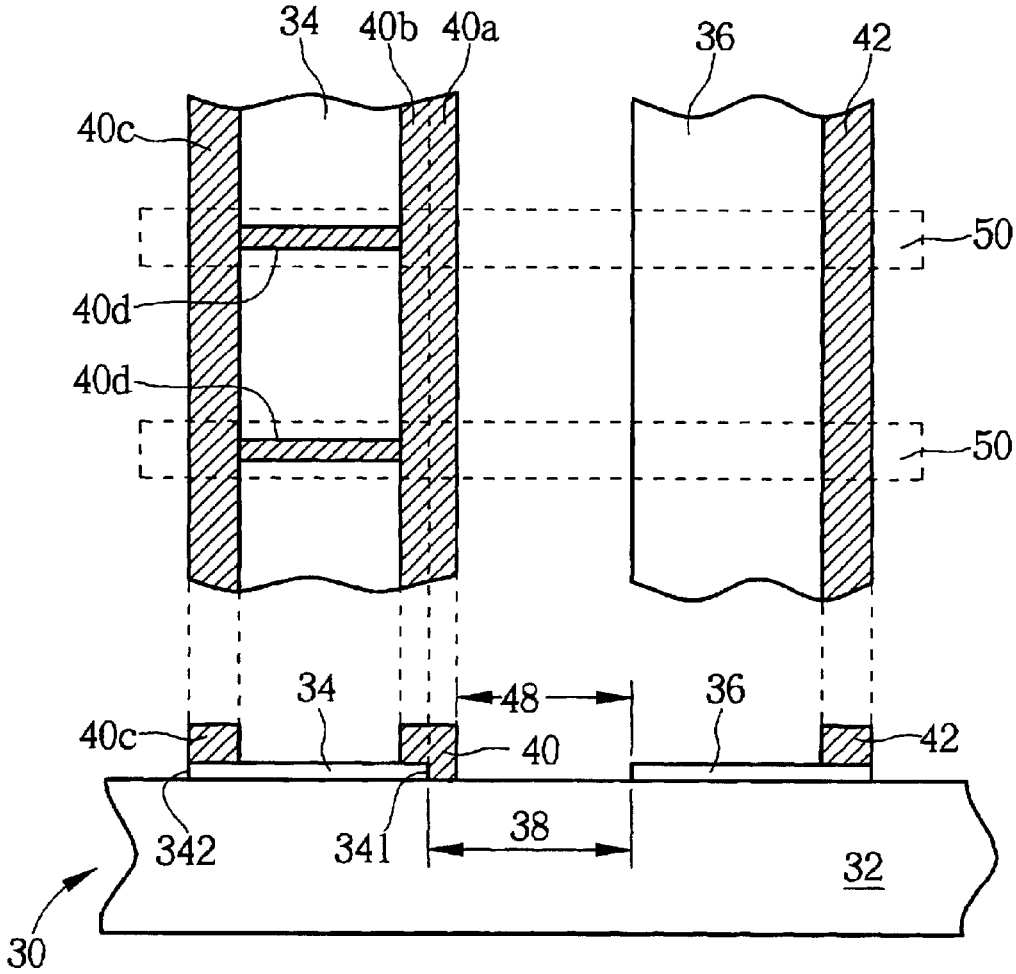

As shown in FIG. 4D, the front substrate 32 of the PDP 30 includes an electrode structure having a first sustaining electrode 34, a second sustaining electrode 36, and a first auxiliary electrode 40. The first sustaining electrode 34 and the second sustaining electrode 36 are formed on the surface of the front substrate 32, and a first gap 38 is defined therebetween. The first auxiliary electrode 40 is electrically connected to the first sustaining electrode 34. The first sustaining electrode 34 includes a first side 341 and a second side 342, the first side 341 is near the second sustaining electrode 36, and the second side 342 is far away from the second sustaining electrode 36. Besides, the first auxiliary electrode 40 includes a first part 40*a*, a second part 40*b*, and a third part 40*c*. The first part 40*a* is formed on the surface of the front substrate 32 in the first gap 38, the second part 40*b* is formed on the first sustaining electrode 34 adjacent to the first side 341, and the third part 40*c* is positioned near the second side 342 of the first sustaining electrode 34. The first auxiliary electrode 40 and the second sustaining electrode 36 are separated by a second gap 48. The width of the second gap 48 is smaller than that of the first gap 38 for achieving the purpose of voltage reduction in the present invention. The third part 40*c* of the first auxiliary electrode 40 is formed above the first sustaining electrode 34 and approaching to the second side 342 of the first sustaining electrode 34. The third part 40*c* of the first auxiliary electrode 40 can also be positioned on the surface of the front substrate 32 (not shown), or above the first sustaining electrode 34 and the front substrate 32 at the same time. The first auxiliary electrode 40 also includes a fourth part 40*d* positioned between the second part 40*b* and the third part 40*c*. The position of the fourth part 40*d* is opposite to the ribs 50 on the back substrate (not shown), so the transparency of the PDP 30 will not be reduced by the fourth part of the auxiliary electrode 40*d*. In addition, each part of the first auxiliary electrode 40 can be electrically connected. A second auxiliary electrode 42 is also formed above the second sustaining electrode 36 to reduce the resistance of the second sustaining electrode 36.

Figure 4E:
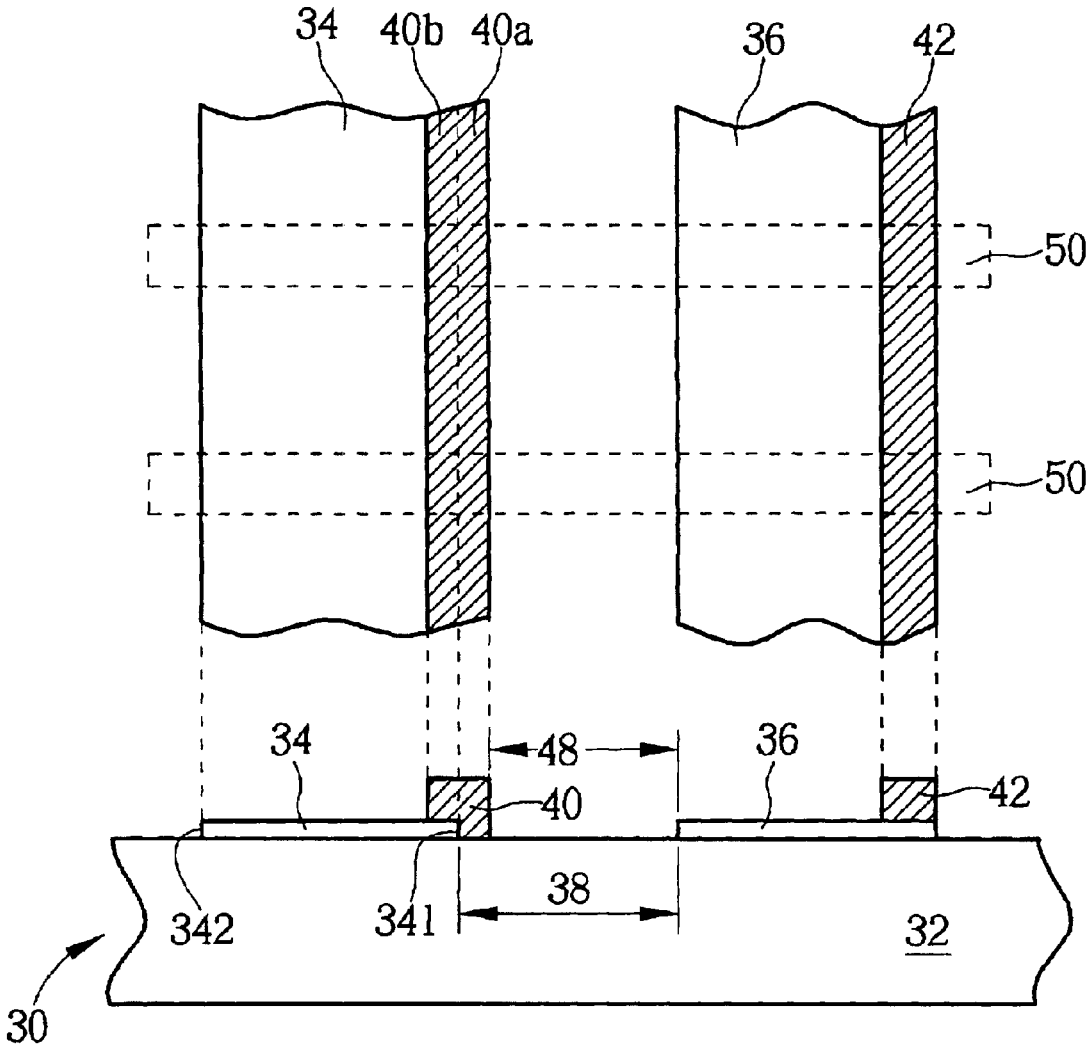

As shown in FIG. 4E, the first auxiliary electrode 40 includes only the first part 40*a* and the second part 40*b*. The first part is formed in the first gap 38, and the second part 40*b* is located above the first sustaining electrode 34 and adjacent to the first side 341 of the first sustaining electrode 34. Both the third 40*c* and fourth part 40*d* are omitted in this embodiment to increase the transparency of the entire front substrate 32.

Figure 4F:
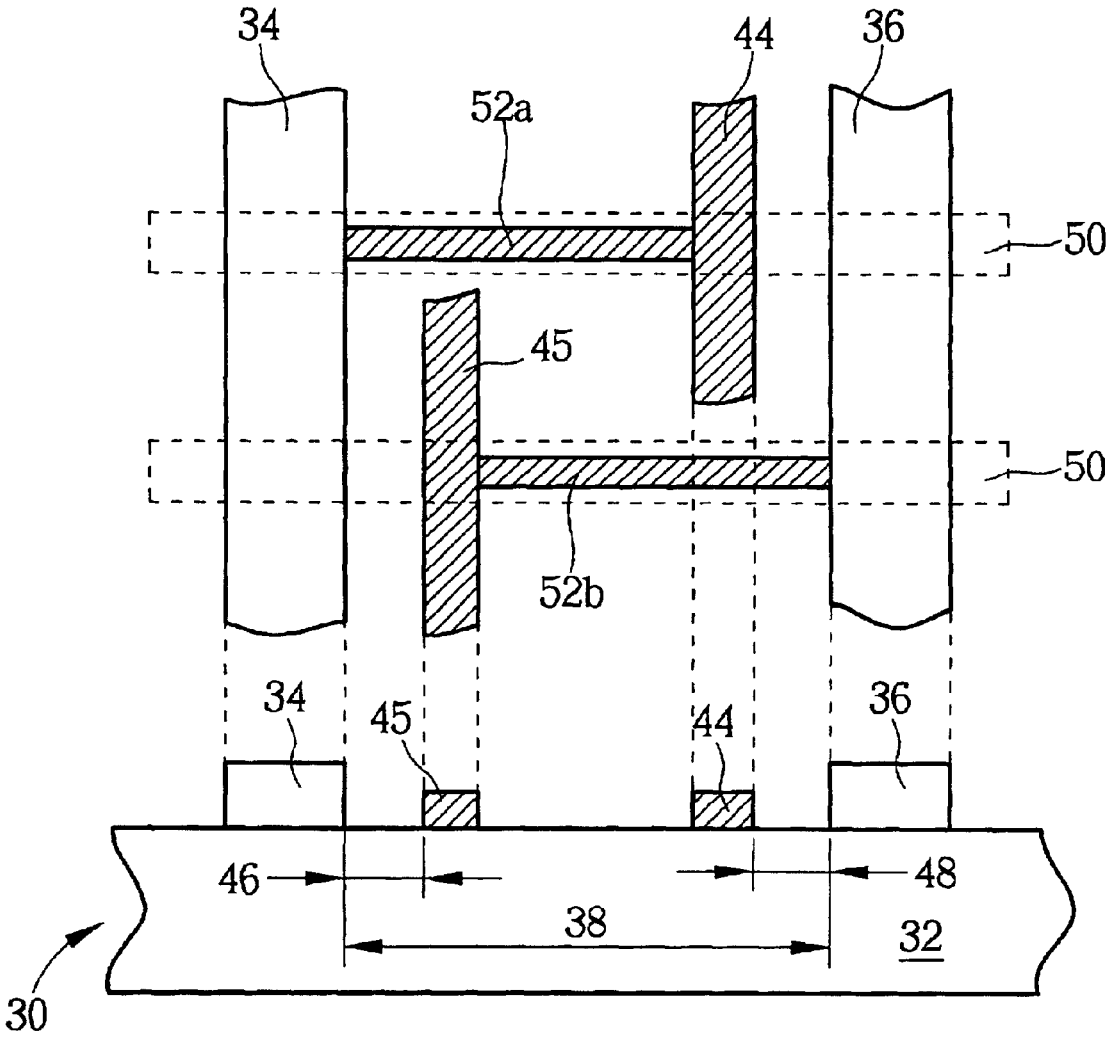

As shown in FIG. 4F, a first auxiliary electrode 44 and a third auxiliary electrode 45 are positioned between the first sustaining electrode 34 and the second sustaining electrode 36. The first auxiliary electrode 44 electrically connects to the first sustaining electrode 34 via a connecting electrode 52*a* and the third auxiliary electrode 45 electrically connects to the second sustaining electrode 36 via a connecting electrode 52*b*. A first gap 38 is defined between the first sustaining electrode 34 and the second sustaining electrode 36. The first auxiliary electrode 44 and the third auxiliary electrode 45 are both located on the first gap 38. A second gap 48 is defined between the first auxiliary electrode 44 and the second sustaining electrode 36, and a third gap 46 is defined between the third auxiliary electrode 45 and the first sustaining electrode 43. The widths of the third gap 46 and the second gap 48 are both smaller than that of the first gap 38 formed by the first sustaining electrode 34 and the second sustaining electrode 36. Therefore, the purpose of reducing the firing voltage of the PDP 30 is again achieved.

Figure 4G:
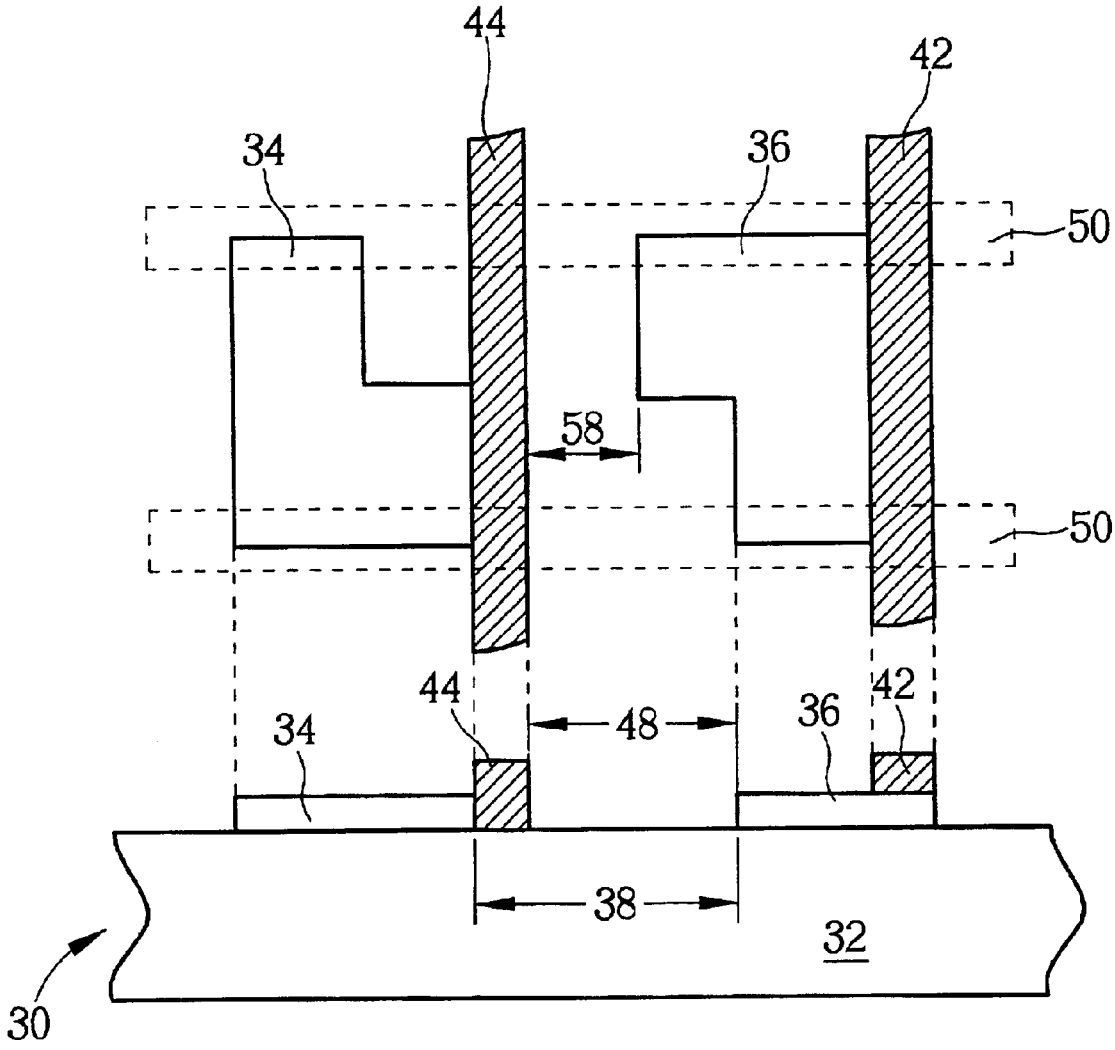

As shown in FIG. 4G, two L-sharp first sustaining electrode 34 and second sustaining electrode 36 are formed in opposition to each other on the surface of the front substrate 32. A first gap 38 is further defined between the first sustaining electrode 34 and the second sustaining electrode 36. A first auxiliary electrode 44 is formed on the surface of the front substrate 32 in the first discharge gap 38 and the first auxiliary electrode 44 is formed adjacent to the first sustaining electrode 34. In addition, a second auxiliary electrode 42 is formed on the surface of the second sustaining electrode 36. The second sustaining electrode 36 has different distances to the first auxiliary electrode 44 for forming a second gap 48 and a third gap 58, respectively. The first auxiliary electrode 44 is electrically connected to the first sustaining electrode 34 and, the second auxiliary electrode 42 is electrically connected to the second sustaining electrode 36. The second gap 45 and the third gap 58 are both smaller than the first gap 38. Therefore, the smaller discharge gaps 48, 58 can be used to reduce the firing voltage of the PDP 30. In addition, the first auxiliary electrode 44 can be simultaneously arranged on the surface of the front substrate 32 as well as on the first sustaining electrode 34.

In this embodiment, two lithographic processes are used to form these sustaining electrodes 34, 36 and these auxiliary electrodes 40, 44, 42, respectively. Therefore, a smaller discharge gap 58 is obtained by properly arranging the relative position of these auxiliary electrodes 40, 42, 44 and these sustaining electrodes 34, 36.

Figure 5A:
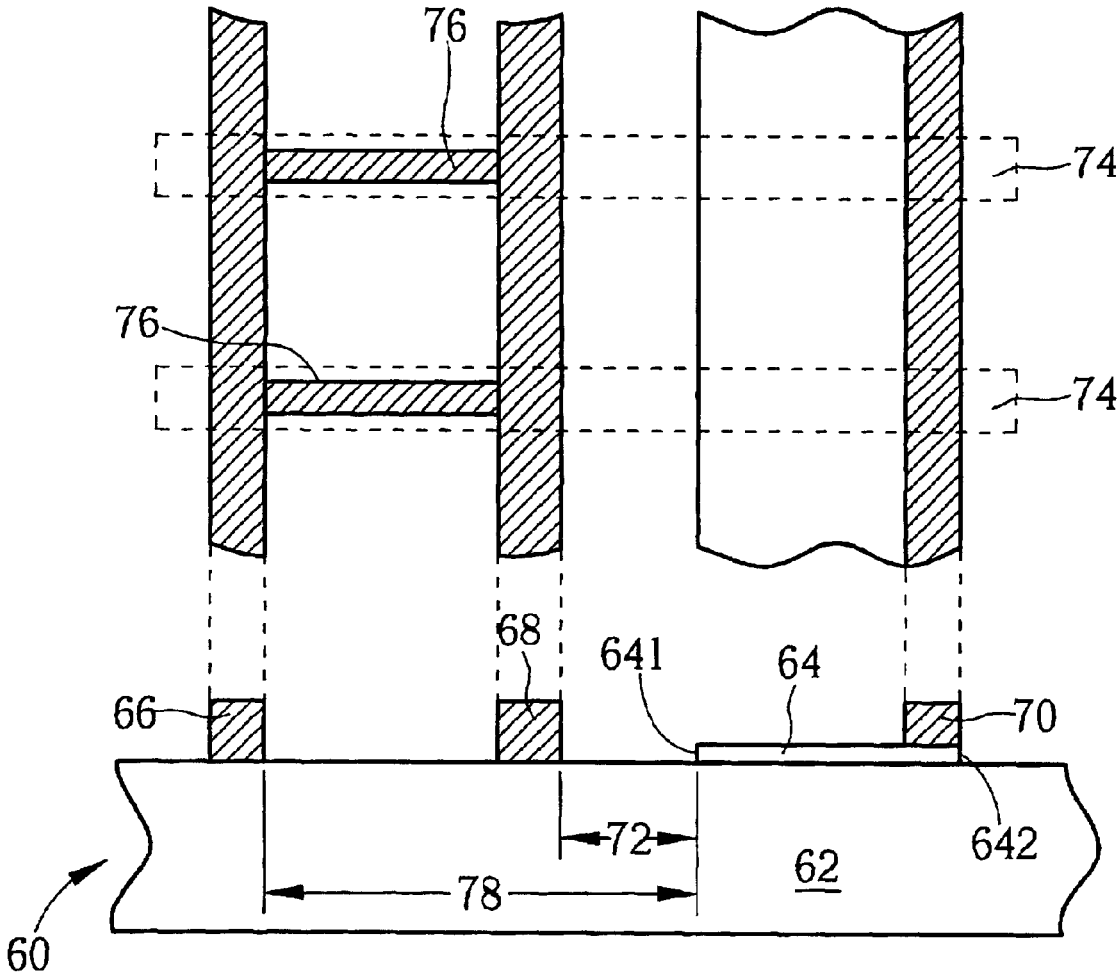
FIG. 5A and FIG. 5B are cross-sectional views of the electrode structure in the second embodiment according to the present invention.
Figure 5B:
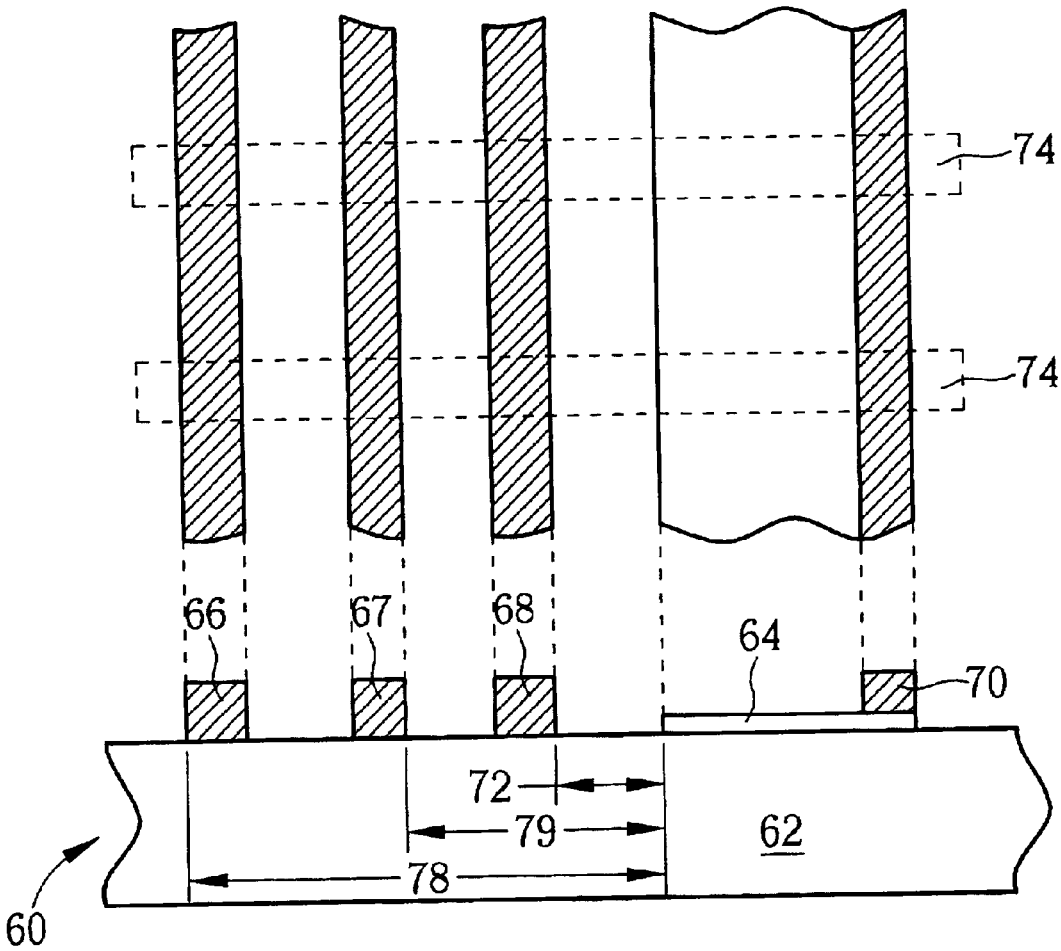

Please refer to FIG. 5A and FIG. 5B. FIG. 5A and FIG. 5B are the cross-sectional views of another embodiment of a PDP 60 according to the present invention. As shown in FIG. 5A, the PDP 60 has a front substrate 62 and an electrode structure including a sustaining electrode 64, a first auxiliary electrode 66, a second auxiliary electrode 68, and a third auxiliary electrode 70. The sustaining electrode 64 is formed on the surface of the front substrate 62. The first auxiliary electrode 66 is also formed on the surface of the front substrate 62 and parallel to the sustaining electrode 64. A first gap exists between the sustaining electrode 64 and a first auxiliary electrode 66. A second auxiliary electrode 68 is also positioned on the surface of the front substrate 62 and parallel to the sustaining electrode 64. A second gap 72 exists between the sustaining electrode 64 and the second auxiliary electrode 68. The second gap 72 is smaller than the first gap 78, therefore, the firing voltage of the PDP 60 can be reduced.

The sustaining electrode 64 has a first side 641 near the second auxiliary electrode 68 and a second side 642 far from the second auxiliary electrode 68. The third auxiliary electrode 70 is located near the second side 642 of the sustaining electrode 64.

There is no sustaining electrode formed beneath the first 66 and the second 68 auxiliary electrodes. As shown in FIG. 5A, two connecting electrode 76 are formed between the first auxiliary electrode 66 and the second auxiliary electrode 68 for electrically connecting the two auxiliary electrodes 66, 68. Besides, the PDP 60 includes a back substrate (not shown) positioned parallel to the front substrate 62, and a plurality of ribs 74 formed on the back substrate 62. The connecting electrodes 76 are positioned in opposite and parallel to the ribs 74 for avoiding the reduction of the transparency of the PDP 60.

Further, the connecting electrode 76 can be omitted for simplifying the fabricating process and increasing the transparency of the PDP 60. The first auxiliary electrode 66 and the second auxiliary electrode 68 will not be connected in the same pixel area, but rather, can be connected in the pad area (not shown) at the edge of the PDP 60.

As shown in FIG. 5B, in order to increase the discharge efficiency of the PDP 60, a fourth auxiliary electrode 67 is further formed on the surface of the front substrate 32. The fourth auxiliary electrode 67 is positioned between the first 66 and the second 68 auxiliary electrodes. A first gap 78 exists between the first auxiliary electrode 66 and the sustaining electrode 64, a second gap 72 exists between the second auxiliary electrode 68 and the sustaining electrode 64, and the third gap 79 exists between the fourth auxiliary electrode 67 and the sustaining electrode 64. The second gap 72 and the third gap 79 are smaller than the first gap 78. The second gap 72, which is the smallest gap, is the discharge gap of the PDP 60.

In this embodiment, a sustaining electrode 64 and plurality of auxiliary electrodes 66, 67, 68, 70 are used for obtaining a smaller discharge gap 72 between, the auxiliary electrode 68 and sustaining electrode 64.

Compared with the prier art, the present invention uses the misalignment of two electrodes to obtain a smaller discharge gap. A first lithographic process is first used to form the sustaining electrodes and a second lithographic process is further used to form the auxiliary electrodes on the surface of the sustaining electrodes and near the sustaining electrodes. Therefore, the discharge gap formed by the auxiliary electrode and the nearby sustaining electrode is not limited by the resolution off the traditional exposure tools or the characteristics of the photoresist materials. A smaller discharge gap can be obtained to improve the image quality of the PDP.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An electrode structure of a plasma display panel (PDP), the electrode structure formed on a front substrate of the PDP, and comprising:

a first sustaining electrode and a second sustaining electrode set on the surface of the front substrate, and a first gap existing between the first and second sustaining electrodes; and a first auxiliary electrode electrically connected to the first sustaining electrode, the first auxiliary electrode comprising a first part and a second part in contact with the first part, the first part formed in the first gap, and the second part located above the first sustaining electrode;

wherein a second gap existing between the first part of the first auxiliary electrode and the second sustaining electrode is used as a discharge gap of the electrode structure of the PDP, and the width of the second gap is smaller than the width of the first gap.

2. The structure of claim 1 wherein the first sustaining electrode has a first side approaching to the second sustaining electrode and a second side not contiguous to the end of the second sustaining electrode.

3. The structure of claim 2 wherein the first auxiliary electrode further comprises a third part approaching to the second side of the first sustaining electrode.

4. The structure of claim 3 wherein the third part of the first auxiliary electrode is located on the first sustaining electrode.

5. The structure of claim 3 wherein the third part of the first auxiliary electrode is located on the surface of the front substrate.

6. The structure of claim 3 wherein the PDP further comprises a back substrate parallel to the front substrate and a plurality of ribs formed on the back substrate and parallel to each other, and the plurality of ribs being perpendicular to the first auxiliary electrode.

7. The structure of claim 6 wherein the first auxiliary electrode further comprises a fourth part parallel to the ribs.

8. The structure of claim 3 wherein the second sustaining electrode comprises a third side not contiguous to the end of the first sustaining electrode, and the electrode structure also comprises a second auxiliary electrode approaching to the third side of the second sustaining electrode.

9. The structure of claim 1 wherein the first and the second sustaining electrodes are defined and patterned by a first lithographic process, and the first auxiliary electrode is defined and patterned by a second lithographic process.

10. An electrode structure of a plasma display panel (PDP), the electrode structure formed on a front substrate of the PDP, and comprising:

a first sustaining electrode and a second sustaining electrode formed on the front substrate, and a first gap existing between the first and second sustaining electrodes; and a first auxiliary electrode formed on the surface of the substrate in the first gap;

wherein a second gap existing between the first auxiliary electrode and the second sustaining electrode is used as a discharge gap of the electrode structure of the PDP, and the width of the second gap is smaller than the width of the first gap.

11. The structure of claim 10 wherein the first sustaining electrode comprises a first side approaching to the second sustaining electrode and a second side not contiguous to the end of the second sustaining electrode, the first auxiliary electrode comprises a first part and a second part, the first part is formed in the first gap, and the second part is located approaching to the second side of the first sustaining electrode.

12. The structure of claim 11 wherein the second part of the first auxiliary electrode is formed above the first sustaining electrode.

13. The structure of claim 11 wherein the second part of the first auxiliary electrode is formed on the surface of the front substrate.

14. The structure of claim 10 wherein the second sustaining electrode comprises a third side not contiguous to the end of the first sustaining electrode, and the electrode structure further comprises a second auxiliary electrode approaching to the third side of the second sustaining electrode.

15. The structure of claim 10, further comprising a third auxiliary electrode located in the first gap, and a third gap existing between the third auxiliary electrode and the first sustaining electrode;

wherein the width of the third gap is smaller than the width of the first gap.

16. The structure of claim 15 wherein the first auxiliary electrode is electrically connected to the first sustaining electrode, and the third auxiliary electrode is electrically connected to the second sustaining electrode.

17. The structure of claim 10 wherein the first sustaining electrode comprises a first side approaching to the second sustaining electrode and a second side not contiguous to the end of the second sustaining electrode, and the first auxiliary electrode is formed on the surface of the front substrate and adjacent to the first side of the first sustaining electrode.

18. An electrode structure of a plasma display panel (PDP), the electrode structure formed on a front substrate of the POP, and comprising:

a first sustaining electrode formed on the surface of the front substrate;

a first auxiliary electrode formed on the surface of the front substrate and parallel to the first sustaining electrode, a first gap existing between the first sustaining electrode and the first auxiliary electrode; and a second auxiliary electrode formed on the surface of the front substrate and parallel to the first sustaining electrode, a second gap existing between the first sustaining electrode and the second auxiliary electrode and being used as a discharge gap of the electrode structure of the PDP, and the width of the second gap being smaller than the width of the first gap.

19. The structure of claim 18 wherein the first sustaining electrode comprises a first side approaching to the second auxiliary electrode and a second side not contiguous to the end of the second auxiliary electrode, and the electrode structure comprises a third auxiliary electrode adjacent to the second side of the first sustaining electrode.

20. The structure of claim 19 wherein a connecting electrode is formed between the first and the second auxiliary electrodes, and the connecting electrode is formed on the surface of the front substrate and perpendicular to the first auxiliary electrode.

21. The structure of claim 19, further comprising a fourth auxiliary electrode formed on the surface of the front substrate, the fourth auxiliary electrode formed between the first and the second auxiliary electrodes, a third gap existing between the fourth auxiliary electrode and the first sustaining electrode, and the width of the third gap is smaller than the width of the first gap.

* * * * *